US010136690B2

(12) United States Patent
Fildan et al.

(10) Patent No.: US 10,136,690 B2
(45) Date of Patent: Nov. 27, 2018

(54) GARMENT FASTENER

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Service Corp., Central (HK)

( * ) Notice: Subject to any disclaimer, the term of this patent is extended or adjusted under 35 U.S.C. 154(b) by 49 days.

(21) Appl. No.: 15/374,317

(22) Filed: Dec. 9, 2016

(65) Prior Publication Data

US 2017/0164671 A1 Jun. 15, 2017

(30) Foreign Application Priority Data

Dec. 9, 2015 (GB) ..... 1521710.2

(51) Int. Cl.

| | |
|---|---|
| ***A41F 1/00*** | (2006.01) |
| ***A41C 3/02*** | (2006.01) |
| ***A41F 15/00*** | (2006.01) |
| ***A44B 17/00*** | (2006.01) |

(52) U.S. Cl.

CPC ..... *A41F 1/006* (2013.01); *A41C 3/02* (2013.01); *A41F 15/002* (2013.01); *A44B 17/0023* (2013.01); *A44B 17/0041* (2013.01)

(58) Field of Classification Search

CPC ..... A41C 3/02; A41F 15/002; A41F 1/006; A44B 17/0023; A44B 17/0041

See application file for complete search history.

(56) References Cited

U.S. PATENT DOCUMENTS

| | | | | |
|---|---|---|---|---|
| 1,851,730 A | | 3/1932 | Rutherford | |
| 2,346,887 A | * | 4/1944 | Winkler | A44C 5/20 24/618 |
| 3,445,901 A | | 5/1969 | Kamper | |
| 4,204,300 A | * | 5/1980 | Fildan | A44B 11/2584 24/578.1 |
| D274,862 S | * | 7/1984 | Fildan | D11/208 |
| 6,149,496 A | | 11/2000 | Fildan | |

(Continued)

FOREIGN PATENT DOCUMENTS

JP 2004218119 A 8/2004

OTHER PUBLICATIONS

UK IPO Search Report in related App. No. GB1621007.2, Pub'd Aug. 16, 2017.

*Primary Examiner* — Robert Sandy
*Assistant Examiner* — David M Upchurch
(74) *Attorney, Agent, or Firm* — Kintner IP, LLC; Mary Frances Ludwig

(57) ABSTRACT

A fastener for a garment, particularly suited to use in a garment such as a brassiere, comprises a female part and a male part that interlock together. The female part is connected to a first garment piece and the male part is connected to a second garment piece. The fastener is an overlapping fastener of the type in which the male piece is engaged with the female piece by inserting a connector plate of a male part into an aperture of a female part at an angle and thereafter pivoting the male part relative the female part thereby snap-fitting the connector plate in place in the aperture. The male part has a recess formed therein surrounding the connector plate which provides added stability to the male part and significantly increases its tensile strength characteristic.

19 Claims, 6 Drawing Sheets

(56) References Cited

U.S. PATENT DOCUMENTS

| | | | | |
|---|---|---|---|---|
| 6,793,556 | B1 | 9/2004 | Fildan et al. | |
| D632,608 | S * | 2/2011 | Corrado | D11/208 |
| 9,756,906 | B1 * | 9/2017 | Fink | A44B 17/0041 |
| 2002/0062539 | A1 * | 5/2002 | Matsushima | A44B 17/0041 24/114.4 |
| 2003/0115727 | A1 * | 6/2003 | Yokozeki | A41F 1/006 24/591.1 |

* cited by examiner 3.00
17
5
1
3
7

1
21
5
19.00
15.00
17
18
16.24
11
19
VI
VI
7
3
8
2.20
1.60
1.60
2.20

5
17
25
21
19
11
3
7
1

18
17
5
3
7
8
1 male/female 15mm male 17mm/female 15mm male 15mm male 17mm female 15mm female 15mm

GARMENT FASTENER

CROSS REFERENCE TO RELATED APPLICATION

This application is entitled to, and claims, a benefit of a right of priority under 35 U.S.C. § 119 from United Kingdom patent application 1521710.2, filed on 9 Dec. 2015, the content of which is incorporated by reference as if fully recited herein.

TECHNICAL FIELD

This invention relates to a fastener for a garment. More particularly, the invention relates to a fastener particularly suited to use in a garment such as a brassiere.

BACKGROUND OF THE INVENTION

There are numerous disparate types of fastener in use today. One particularly successful fastener is described in U.S. Pat. No. 6,793,556 in the name of Fildan Accessories Corporation and having the same inventor(s) as the present application. U.S. Pat. No. 6,793,556 describes a front closure for a fastener that is slim, lightweight, practically invisible from the outside of the garment, and that may be incorporated into a brassiere with relative ease. Although very successful and effective, there are improvements that could be made to such a fastener.

For example, although the fastener described in U.S. Pat. No. 6,793,556 is ideally suited as a front closure for a brassiere, it is not particularly suited to many other closure applications, such as a strap fastener for a bra, bikini, or top with interchangeable straps. This is due to the fact that the tensile stress rating of the known fastener is typically much less than 10 kgs and is insufficient for the other purposes. Accordingly, if interchangeable straps are to be provided, a second, different type of fastener must also be used in the garment. This is inconvenient and inefficient from a manufacturing standpoint and may result in an increase in the manufacturing cost of the garment. This could be avoided if the tensile stress rating of the fastener could be increased to a level suitable for use with interchangeable straps as well as front fasteners.

Furthermore, inadvertent release of a fastener can be a source of inconvenience and embarrassment. Irrespective of the benefits of opening up new markets and simplifying manufacturing by increasing the tensile stress rating of the fastener, it is also advantageous to increase the tensile stress rating in any event as it will decrease the likelihood of the fastener becoming inadvertently undone.

Other fasteners of similar construction have been disclosed in the art. For example, U.S. Pat. No. 6,149,496 in the name of Fildan, a co-inventor of the present application, discloses a hidden front closure brassiere. The closure is relatively flat and may be sewn into the fabric of the brassiere. UK Pat. No. GB1,125,255 in the name of Brero & Co, discloses a fastener with a hammerhead construction that when closed, is substantially flat. Japanese Patent App. Pub. No. J2004218119 in the name of Gunze KK, discloses a front fastener for a brassiere that claims to be easier to handle that existing offerings. U.S. Pat. No. 2,346,887 in the name of Winkler discloses an alternative construction of fastener for jewelry such as necklaces and bracelets. The fastener is relatively flat when in a closed configuration.

However, none of these fasteners adequately overcome the problems outlined above. More specifically, the fasteners disclosed are not particularly suited to many other closure applications, such as a strap fastener for a bra, bikini, or top with interchangeable straps. This is due to the fact that the tensile stress rating of these fasteners is believed to be typically much less than 10 kgs, which is unsuitable for many applications.

It is an object of the present invention to provide a fastener that overcomes at least some of the above-identified problems and that provides a useful choice to the consumer.

BRIEF SUMMARY OF THE INVENTION

There is provided a garment fastener comprising a female part and a male part, the female part comprising a female base plate for securing the female part to a first garment piece, and an overlapping connector loop mounted on the female base plate and offset relative thereto, the connector loop defining an elongate aperture therein, a roofed portion of which overlaps and is roofed in by the female base plate and part of which extends beyond the female base plate in an open mouth;

the male part comprising a male base plate for securing the male part to a second garment piece and an overlapping connector plate mounted on the male base plate and offset relative thereto, the connector plate being dimensioned for insertion and retention in the elongate aperture in the female part;

the connector plate, the open mouth and the elongate aperture of the connector loop being dimensioned so that insertion of the connector plate into the elongate aperture must be realized by inclining the male part relative to the female part before inserting the connector plate into the open mouth of the elongate aperture and bringing the male part and the female part together, retention of the connector plate in the elongate aperture of the connector loop is realized by snap fitting the connector plate in place by pivoting the fully inserted connector plate from the inclined orientation to an orientation wherein the male base plate and the female base plate are substantially co-planar using the roofed portion of the elongate aperture as a fulcrum until a trailing abutment edge of the connector plate snaps into position in the elongate aperture, and release of the connector plate from the elongate aperture is realized by pivoting the inserted male part from the co-planar orientation back to the inclined orientation using the roofed portion of the elongate aperture as a fulcrum to release the abutment edge from the elongate aperture before moving the male part and the female part apart; and, in which there is provided a recess in the male base plate surrounding on three sides the portion of the connector plate overlapped by the male base plate.

By having such a fastener, the fastener will provide a more secure engagement between the male part and the female part and will have a greater tensile strength rating than the known equivalent fasteners. The fastener can be made ultra-slim, less than 4 mm in depth from top to bottom, while maintaining greater structural integrity and the ability to resist inadvertent opening under an applied load. Typically, fasteners of this type would be unsuitable for applications with loads over a few kilograms thereby significantly limiting their use. It is possible to increase the tensile strength rating of the known fasteners by providing additional fabric backing layers, however this will only increase the tensile strength rating to of the order of 12 kg. The provided fastener will have a standard tensile strength of the order of 13.6 kg, a 13.3% increase. This is also achieved without the need for additional fabric backing layers so the increase on equivalent designs (i.e. those without a fabric backing layer) is even greater.

It is important that the fastener can remain ultra-slim (below 4 mm) as this will allow the fastener to be used under other garments without being unsightly and affecting the drape of the garment under which it is placed. The fastener of the present embodiment will have a depth from top to bottom of the order of 0.0029 m (2.9 mm) to 0.003 m (3.0 mm) which is particularly advantageous.

Furthermore, due to the substantial increase in tensile strength rating, the fastener can be used in a wide range of disparate areas. For example, as well as performing the role of a front or rear clasp on a brassiere, the fastener could now also be used as a fastener on a brassiere shoulder strap for sports bras or for bras where interchangeable straps are desirable.

In one embodiment there is provided a fastener in which the recess has a substantially semi-elliptical shape on an edge opposing the connector plate. By having a semi-elliptical shaped recess, the stresses and strains on the fastener will be evenly distributed, thereby reducing the likelihood of the fastener failing under applied forces.

In one embodiment there is provided a fastener in which the aperture and the connector plate are substantially oblong-shaped.

In one embodiment there is provided a fastener in which the abutment edge of the connector plate is arcuate along its length with the center of the abutment edge trailing the ends of the abutment edge. This is seen as a particularly preferred embodiment of the fastener. By providing such a fastener, the fastener will be relatively straightforward to open once it is desired to do so but at the same time, there will not be increased play between the male and female members and the fastener's tensile strength rating will not be significantly adversely affected.

In one embodiment there is provided a fastener in which the side of the connector plate intermediate the abutment edge and the male base plate is inclined rearwardly from the male base plate to the abutment edge. Again, this is seen as a very useful embodiment of the fastener. By inclining the side of the connector plate in this way, the tensile strength rating of the connector plate will be increased as the configuration of the connector plate will act to resist dislodgement of the connector plate from the aperture under an applied tensile force.

In one embodiment there is provided a fastener in which the leading side of the elongate aperture is inclined rearwardly as it extends in the direction towards the female base plate. In this way, the inclined face of the elongate aperture will co-operate with the inclined face of the connector plate and both will act to resist dislodgement of the connector plate from the aperture under an applied tensile force.

In one embodiment there is provided a fastener in which the recess is between about 0.0001 m (0.1 mm) and about 0.0003 m (0.3 mm) deep. In one embodiment there is provided a fastener in which the recess is of the order of 0.0002 m (0.2 mm) deep. This depth is seen as ideal to maintain sufficient structural rigidity in the male base plate. In one embodiment there is provided a fastener in which the recess extends across the width of the male base plate.

In one embodiment there is provided a fastener in which the male and female base plates comprise a hinge joint extending across their width. By having a hinge joint, the fastener will be able to more closely follow the contours of the wearer's body and will be more comfortable and aesthetically pleasing to wear.

In one embodiment there is provided a fastener in which the hinge joint comprises a recessed channel extending across the width of the base plate. This is seen as a simple way to provide the hinge joint at little expense.

In one embodiment there is provided a fastener in which the recessed channel extending across the width of the base plate is of the order of 0.00015 m (0.15 mm) deep.

In one embodiment there is provided a fastener in which the base plate is of the order of 0.0007 m (0.7 mm) deep. By having a base plate of the order of 0.0007 m deep, it will be possible to penetrate the base plate with a sewing needle with relative ease, thereby allowing the base plate to be stitched directly into the garment.

In one embodiment there is provided a fastener in which the maximum depth of the female part from front to back is of the order of between about 0.0028 m (2.8 mm) and about 0.0031 m (3.1 mm) deep.

In one embodiment there is provided a fastener in which the maximum depth of the female part from front to back is of the order of between 0.0029 m (2.9 mm) and 0.0030 m (3.0 mm) deep. It is envisaged also that the body of the closure could be curved or convex with the thinnest part of the body being of the order of 0.0019 m (1.9 mm) and 0.0020 m (2.0 mm) deep but with the maximum overall depth from the top of the curve to the bottom of the curve still being of the order of between 0.0029 m (2.9 mm) and 0.0030 m (3.0 mm) deep.

In one embodiment there is provided a fastener in which there is provided an opening in each of the male and female base plates for reception of the garment piece. By having an opening in the base plate, it will not be necessary to make the base plate shallower in order to allow it to be penetrated by a needle and instead the straps or other (preferably fabric) piece to which the base is to be connected can be passed through the opening and then stitched back on itself. It is simpler to stitch fabric in this way.

In one embodiment there is provided a fastener in which the width of one of the male and female parts is greater than the width of the other of the male and female parts. It is envisaged that several different interchangeable male or female parts could be provided. For example, a brassiere with cups and interchangeable straps could be provided and the male or female part that is connected on one end of the interchangeable straps could be different sizes depending on the material of strap used or depending on the design of the strap.

In one embodiment there is provided a brassiere having a fastener as claimed. The fastener according to the present embodiment is deemed particularly suitable for use with a brassiere due to the tensile strength rating and the fact that the fastener can be provided in a very low profile size.

Other embodiments, in addition to the embodiments enumerated above, will become apparent from the following detailed description, taken in conjunction with the accompanying drawings, which illustrate, by way of example, the principles of the fastener and garment incorporating same.

BRIEF DESCRIPTION OF THE DRAWINGS

The invention will now be more clearly understood from the following description of some embodiments thereof given by way of example only with reference to the accompanying drawings, in which.

DETAILED DESCRIPTION OF THE INVENTION

Figure 1:
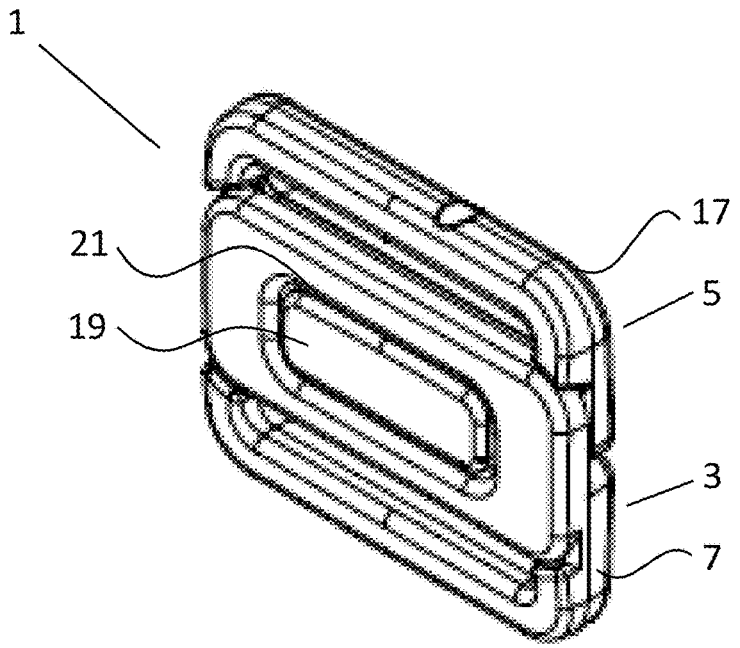
FIG. 1 is a perspective view of a closed fastener.
Figure 2:
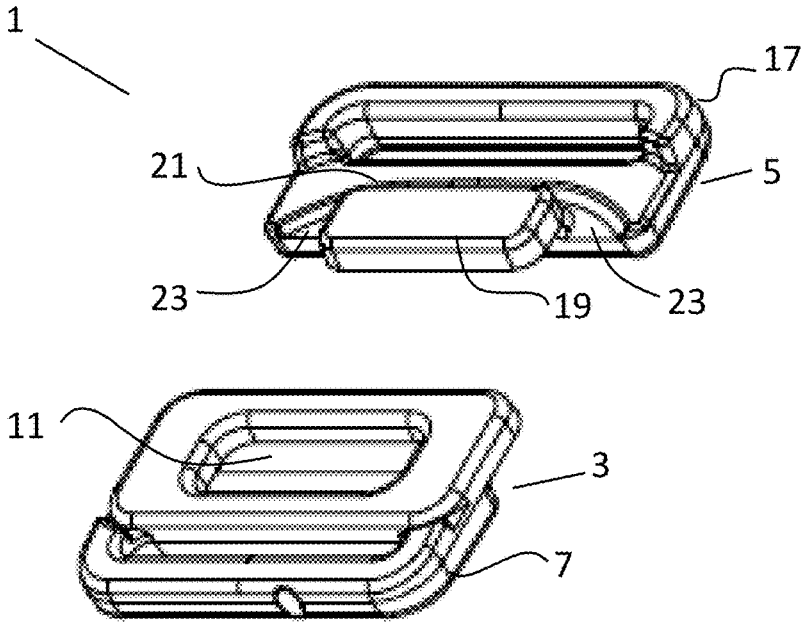
FIG. 2 is a perspective view of an open fastener.

Referring to FIGS. 1 to 14 inclusive, there is shown a fastener, indicated generally by the reference numeral 1, comprising a female part 3 and a male part 5 that interlock together. The female part is connected to a first garment piece (not shown) and the male part is connected to a second garment piece (not shown). The female and male parts, when joined together, by extension connect the first and second garment pieces together.

Referring specifically to FIGS. 11 to 14 inclusive, the female part 3 comprises a female base plate 7 for securing the female part to a first garment piece (not shown), and an overlapping connector loop 9 mounted on the female base plate and offset relative thereto. The connector loop 9 defines an elongate aperture 11 therein, a roofed portion 13 of which overlaps and is roofed in by the female base plate 7, and an open mouth 15 of which extends beyond the female base plate 7. The female base plate 7 has an opening 8 for reception of the first garment piece.

Referring specifically to FIGS. 7 to 10 inclusive, the male part 5 comprises a male base plate 17 for securing the male part 5 to a second garment piece (not shown) and an overlapping connector plate 19 mounted on the male base plate and offset relative thereto. The male base plate 17 has an opening 18 for reception of the second garment piece. The connector plate 19 is dimensioned for insertion and retention in the elongate aperture 11 in the female part. The connector plate 19 comprises a trailing abutment edge 21, the operation of which will be described in more detail below. Most importantly, there is further provided a recess 23 in the male base plate 17 surrounding the overlapped portion of the connector plate 19.

The connector plate 19, the open mouth 15, and the elongate aperture 11 of the connector loop 9 are dimensioned so that insertion of the connector plate 19 into the aperture 11 must be realized by inclining the male part 5 relative to the female part 3 before inserting the connector plate 19 into the open mouth 15 of the aperture 11 and bringing the male part 5 and the female part 3 together. Retention of the connector plate 19 in the aperture 11 of the connector loop 9 is realized by snap fitting the connector plate 19 into place by pivoting the fully inserted connector plate 19 from the inclined orientation to an orientation wherein the male base plate 17 and the female base plate 7 are substantially co-planar. This pivoting motion is achieved by using the roofed portion 13 of the aperture 11 as a fulcrum until a trailing abutment edge 21 of the connector plate 19 snaps into position in the aperture 11. The release of the connector plate from the aperture 11 is realized by pivoting the inserted male part 5 from the co-planar orientation back to the inclined orientation using the roofed portion 13 of the aperture 11 as a fulcrum to release the abutment edge 21 from the aperture 11 before moving the male part 5 and the female part 3 apart.

Figures 3, 4, 5, 6:
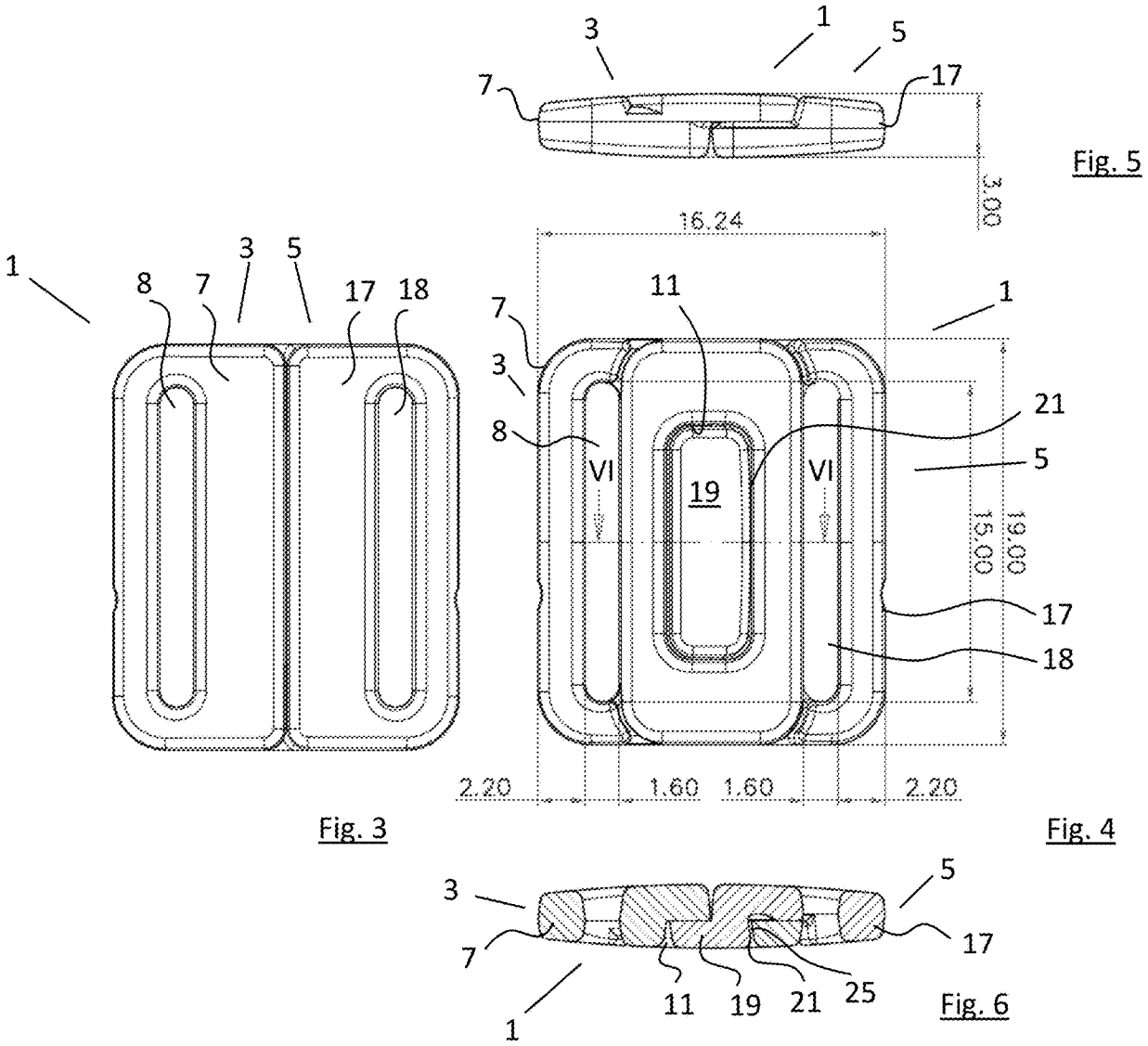
FIG. 3 is a front view of the closed fastener.
FIG. 4 is a rear view of the closed fastener of FIG. 3.
FIG. 5 is a top view of the fastener of FIG. 3.
FIG. 6 is a cross sectional view along the lines VI-VI of FIG. 4.
Figure 7:
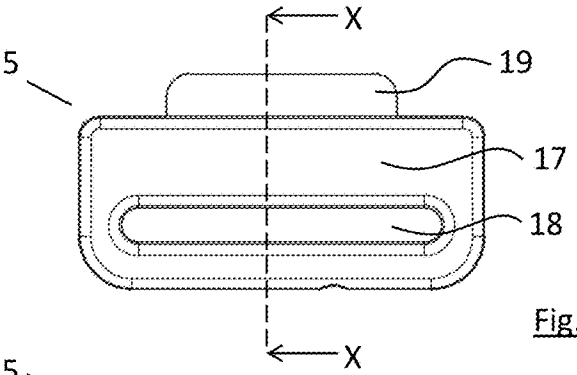
FIG. 7 is a front view of the male part of the fastener.
Figure 9:
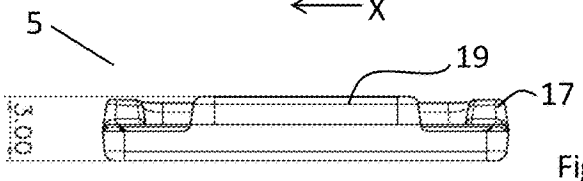
FIG. 9 is a top view of the male part of FIG. 7.
Figure 8:
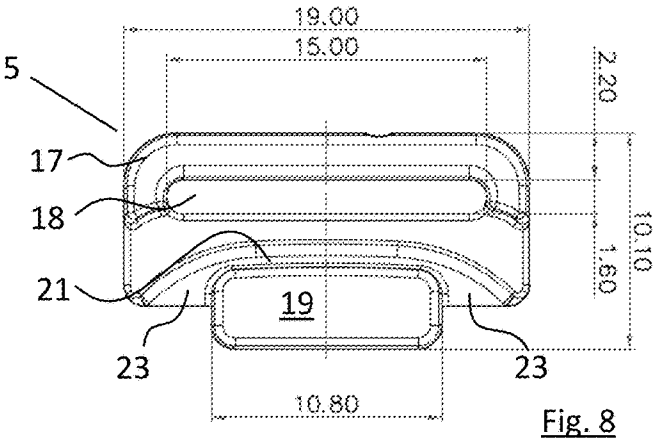
FIG. 8 is a rear view of the male part of FIG. 7.

It can be seen from the drawings that the aperture 11 and the connector plate 19 are substantially oblong in shape. Referring specifically to FIGS. 4 and 8, it can be seen that the abutment edge 21, as well as being curved at its ends, is in fact curved rather than being straight along its length intermediate its ends. In this way, the middle of the abutment edge trails the ends of the abutment edge and the middle of the abutment edge will predominantly contact with the side of the aperture 11. Importantly this will facilitate opening and closing of the fastener while not increasing the amount of play between the male part 5 and the female part 3.

Figure 10:
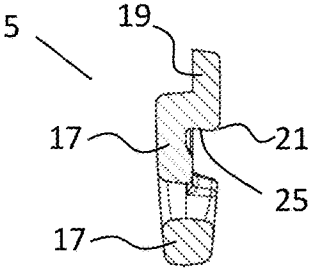
FIG. 10 is a cross sectional view along the lines X-X of FIG. 7.
Figure 11:
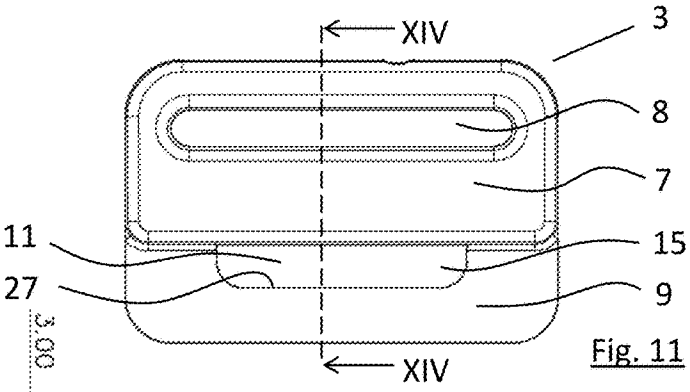
FIG. 11 is a front view of the female part of the fastener.
Figure 13:
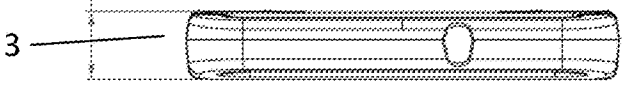
FIG. 13 is a top view of the female part of FIG. 11.
Figure 12:
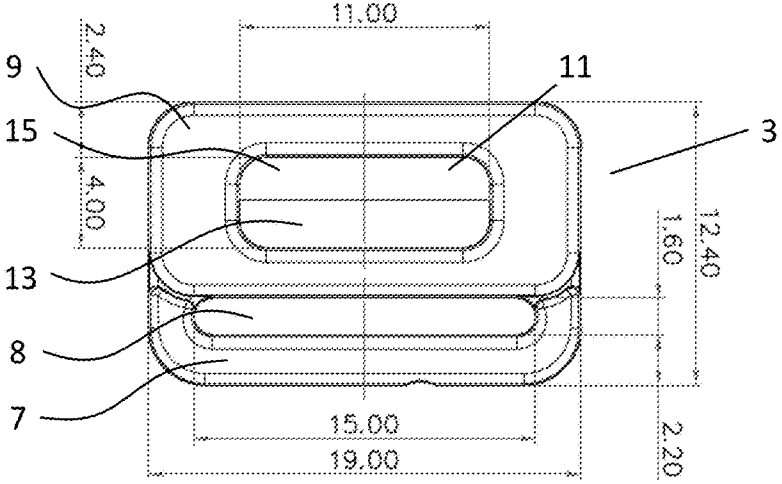
FIG. 12 is a rear view of the female part of FIG. 11.
Figure 14:
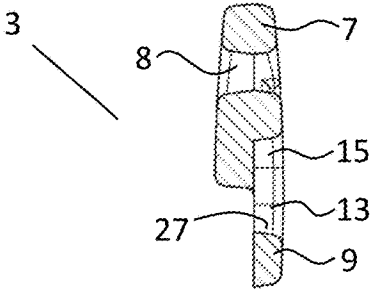
FIG. 14 is a cross sectional view along the lines XIV-XIV of FIG. 11.
Figure 16:
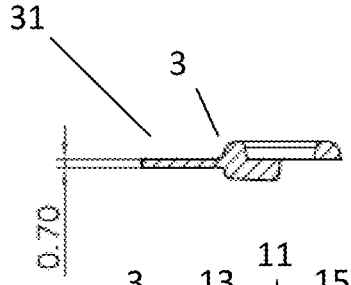
FIG. 16 is a cross sectional view along the lines XVI-XVI of FIG. 15.
Figure 15:
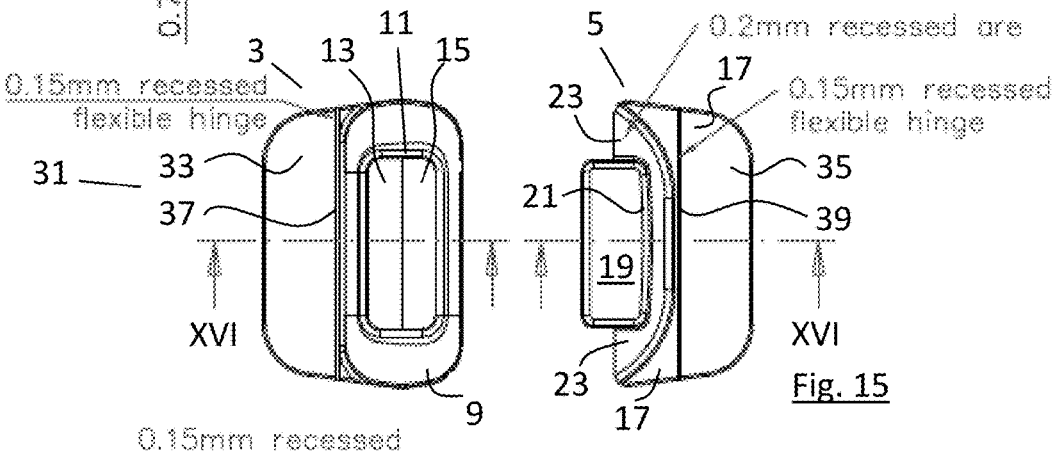
FIG. 15 is a rear view of an alternative embodiment of fastener in an open configuration.
Figure 18:
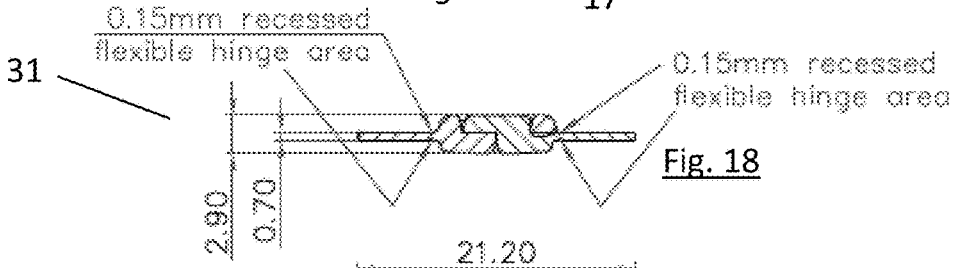
FIG. 18 is a cross sectional view along the lines XVIII-XVIII of FIG. 17.
Figure 17:
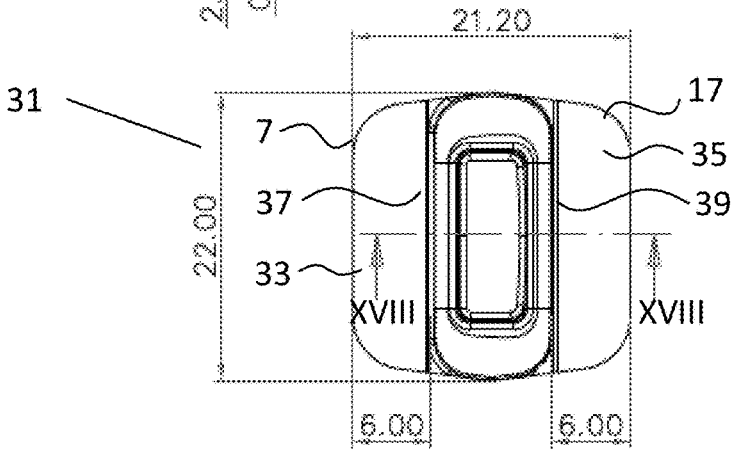
FIG. 17 is a rear view of the alternative embodiment of fastener of FIG. 15 in a closed configuration.
Figure 19:
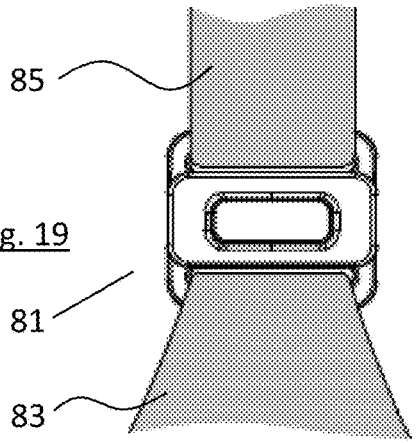
FIG. 19 is a rear view of a second alternative embodiment of the fastener connecting two pieces.

Referring to FIGS. 6 and 10, it can be seen that the side 25 of the connector plate 19 between the abutment edge 21 and the male base plate 17 is inclined rearwardly from the male base plate to the abutment edge. Similarly, referring to FIGS. 10 and 14, the leading side 27 of the elongate aperture 11 is inclined rearwardly as it extends in the direction towards the female base plate. This has the effect of increasing the tensile strength rating of the fastener as a tensile force directed to separate the two parts will in fact first have a tendency to pull them closer together.

The fastener 1 differs from known fasteners predominantly in that there is provided the recess 23 in the male base plate 17 surrounding the overlapped portion of the connector plate 19. The recess is of the order of 0.2 mm in depth and the recess 23 is semi-elliptical or semi-oval in shape. This recess 23 has the direct effect of substantially increasing the tensile strength rating of the fastener 1 and the fastener 1 will be able to withstand up to 13.6 kgs of tensile stress before the fastener will open.

Referring now to FIGS. 15 to 18 inclusive, there is shown an alternative embodiment of the fastener, indicated generally by the reference numeral 31 and where like parts have been given the same reference numeral as before. The fastener 31 is similar in many respects to the fastener 1 in that it also has a semi-elliptical recess in the male base plate 17 of the male part 5 surrounding the connector plate 19. However, the fastener 31 differs from the fastener 1 in that the female base plate 7 and the male base plate 17 each comprise a flap 33, 35, respectively, separated from the remainder of the base plates 7, 17 by a hinge 37, 39 respectively. The hinges 37, 39 are formed by a recessed channel formed along the width of the flap 33, 35. The flaps are of the order of 0.7 mm deep and can be penetrated by a needle. In this way, the female part and the male part may be stitched directly onto a first garment piece and a second garment piece, respectively.

Figure 21:
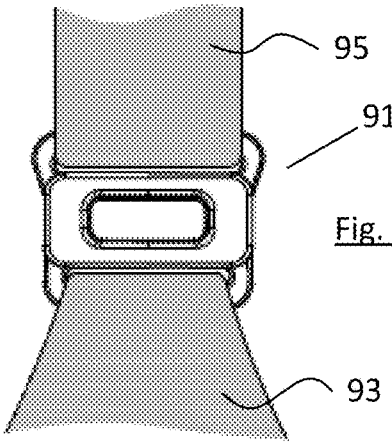
FIG. 21 is a rear view of a third alternative embodiment of the fastener connecting two pieces; and, FIG. 22 is a rear view of the fastener of FIG. 21 shown open.
Figure 20:
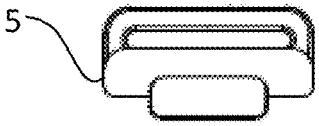
FIG. 20 is a rear view of the fastener of FIG. 19 shown open.
Figure 20:
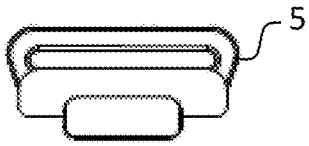
Figure 22:
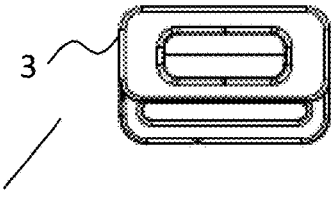
Figure 22:
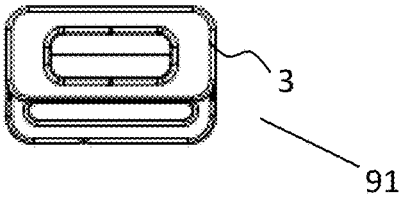

Referring now to FIGS. 19 to 22 inclusive, there are shown views of two separate fasteners 81 (FIGS. 19 and 20) and 91 (FIGS. 21 and 22). The fasteners 81, 91 are of a type similar to that shown in FIGS. 1 to 14 inclusive. Some detail of the fasteners has been omitted for clarity. The fasteners 81, 91 are each shown connected to a first garment piece 83, 93, and a second garment piece 85, 95 respectively. The fasteners 81, 91 both share an identical female part 3 which is 15 mm wide. However, the fasteners 81, 91 differ in that the male part 5 of the fastener 81 is 15 mm wide whereas the male part 5 of the fastener 91 is 17 mm wide. In this way, it can be seen how a number of different sized male parts could be provided for a single female part (or vice versa) so that a number of different sized/colored straps and a number of different material straps can be used with the same female part. In this way, it will be understood that the fasteners as described lend themselves to providing interchangeable straps.

Various materials could be used to construct the fastener. One material that has been found to be effective, robust and capable of providing the structural integrity required is nylon.

In this specification the terms "comprise, comprised, comprises and comprising" and the terms "include, includes, included and including" are all deemed totally interchangeable and should be afforded the widest possible interpretation.

The embodiments of the fastener described herein and garments incorporating same are exemplary and numerous modifications, combinations, variations, and rearrangements can be readily envisioned to achieve an equivalent result, all of which are intended to be embraced within the scope of the appended claims. Further, nothing in the above-provided discussions of the fastener and garment should be construed as limiting the invention to a particular embodiment or combination of embodiments. The scope of the invention is defined by the appended claims.

The invention claimed is:

1. A garment fastener comprising:

a female part comprising a female base plate for securing the female part to a first garment piece, and an overlapping connector loop mounted on the female base plate and offset relative thereto, the connector loop defining an elongate aperture therein, a roofed portion of which overlaps and is roofed in by the female base plate and a part of which extends beyond the female base plate in an open mouth;

a male part comprising a male base plate for securing the male part to a second garment piece and an overlapping connector plate mounted on the male base plate and offset relative thereto, the connector plate being dimensioned for insertion and retention in the elongate aperture in the female part;

the connector plate, the open mouth, and the elongate aperture of the connector loop being dimensioned so that insertion of the connector plate into the elongate aperture must be realized by inclining the male part relative to the female part before inserting the connector plate into the open mouth of the elongate aperture and bringing the male part and the female part together, retention of the connector plate in the elongate aperture of the connector loop is realized by snap fitting the connector plate in place by pivoting the fully inserted connector plate from the inclined orientation to an orientation wherein the male base plate and the female base plate are substantially co-planar using the roofed portion of the elongate aperture as a fulcrum until a trailing abutment edge of the connector plate snaps into position in the elongate aperture, and release of the connector plate from the elongate aperture is realized by pivoting the inserted male part from the co-planar orientation back to the inclined orientation using the roofed portion of the elongate aperture as a fulcrum to release the abutment edge from the elongate aperture before moving the male part and the female part apart; and, in which there is provided a recess in the male base plate surrounding on three sides the portion of the connector plate overlapped by the male base plate.

2. The fastener of claim 1 in which the recess has a substantially semi-elliptical shape on an edge opposing the connector plate.

3. The fastener of claim 1 in which the elongate aperture and the connector plate are substantially oblong-shaped.

4. The fastener of claim 1 in which the abutment edge of the connector plate is arcuate along its length, the abutment edge has a center and two ends, and the center of the abutment edge trails the ends of the abutment edge.

5. The fastener of claim 1 in which the connector plate has a side intermediate the abutment edge and the male base plate, and the side is inclined rearwardly from the male base plate to the abutment edge.

6. The fastener of claim 5 in which the elongate aperture has a leading side which is inclined rearwardly as it extends in the direction towards the female base plate.

7. The fastener of claim 1 in which the recess is between about 0.1 mm and about 0.3 mm deep.

8. The fastener of claim 1 in which the recess is of the order of 0.2 mm deep.

9. The fastener of claim 1 in which the recess extends across a major dimension of the male base plate.

10. A garment fastener comprising:

a female part comprising a female base plate for securing the female part to a first garment piece, and an overlapping connector loop mounted on the female base plate and offset relative thereto, the connector loop defining an elongate aperture therein, a roofed portion of which overlaps and is roofed in by the female base plate and a part of which extends beyond the female base plate in an open mouth;

a male part comprising a male base plate for securing the male part to a second garment piece and an overlapping connector plate mounted on the male base plate and offset relative thereto, the connector plate being dimensioned for insertion and retention in the elongate aperture in the female part;

the connector plate, the open mouth, and the elongate aperture of the connector loop being dimensioned so that insertion of the connector plate into the elongate aperture must be realized by inclining the male part relative to the female part before inserting the connector plate into the open mouth of the elongate aperture and bringing the male part and the female part together, retention of the connector plate in the elongate aperture of the connector loop is realized by snap fitting the connector plate in place by pivoting the fully inserted connector plate from the inclined orientation to an orientation wherein the male base plate and the female base plate are substantially co-planar using the roofed portion of the elongate aperture as a fulcrum until a trailing abutment edge of the connector plate snaps into position in the elongate aperture, and release of the connector plate from the elongate aperture is realized by pivoting the inserted male part from the co-planar orientation back to the inclined orientation using the roofed portion of the elongate aperture as a fulcrum to release the abutment edge from the elongate aperture before moving the male part and the female part apart;

in which there is provided a recess in the male base plate surrounding the portion of the connector plate overlapped by the male base plate; and, in which the male base plate and the female base plate each include a hinge joint extending across a major dimension thereof.

11. The fastener of claim 10 in which the hinge joint comprises a recessed channel extending across the width of the base plate.

12. The fastener of claim 11 in which the recessed channel is of the order of 0.15 mm deep.

13. The fastener of claim 10 in which the male base plate and the female base plate are of the order of 0.7 mm deep.

14. The fastener of claim 1 in which the female part has a maximum depth from front to back of between about 2.8 mm and about 3.1 mm deep.

15. The fastener of claim 1 in which the female part has a maximum depth from front to back of between about 2.9 mm and about 3.1 mm.

16. The fastener of claim 1 in which there is provided an opening in each of the male base plate and the female base plate for reception of a garment piece.

17. The fastener of claim 1 in which a major dimension of either one of the male part or the female part is greater than the major dimension of the other one of the male part or the female part.

18. A brassiere including the fastener of claim 1.

19. A brassiere including the fastener of claim 10.

* * * * *